US006640480B2

(12) United States Patent
Williams et al.

(10) Patent No.: US 6,640,480 B2
(45) Date of Patent: Nov. 4, 2003

(54) GUN CLEANING KIT

(76) Inventors: Lawrence J. Williams, R.R. #1 Box 84, Boonville, NY (US) 13309; Nicholas Williams, R.R. #1 Box 84, Boonville, NY (US) 13309

( * ) Notice: Subject to any disclaimer, the term of this patent is extended or adjusted under 35 U.S.C. 154(b) by 0 days.

(21) Appl. No.: 10/055,283

(22) Filed: Jan. 23, 2002

(65) Prior Publication Data

US 2003/0136044 A1 Jul. 24, 2003

(51) Int. Cl.[7] ..... F41A 29/02
(52) U.S. Cl. ..... 42/95
(58) Field of Search ..... 42/95, 50, 71.01

(56) References Cited

U.S. PATENT DOCUMENTS

| | | | | | |
|---|---|---|---|---|---|
| 856,016 | A | | 6/1907 | Balson | |
| 1,245,499 | A | | 11/1917 | Orme | |
| 2,298,678 | A | | 10/1942 | Chase | |
| 2,744,275 | A | | 5/1956 | Geltner | |
| 2,834,973 | A | | 5/1958 | Frisen | |
| 4,329,802 | A | * | 5/1982 | Coonan | 42/50 |
| 4,484,404 | A | * | 11/1984 | Johnson | 42/18 |
| 4,514,922 | A | * | 5/1985 | Farrar et al. | 42/50 |
| 4,516,346 | A | * | 5/1985 | Farrar et al. | 42/50 |
| 4,570,370 | A | * | 2/1986 | Smith et al. | 42/7 |
| 4,697,368 | A | * | 10/1987 | Williams | 42/59 |
| 4,716,673 | A | | 1/1988 | Williams et al. | |
| 5,048,215 | A | | 9/1991 | Davis | |
| 5,099,595 | A | | 3/1992 | Chesnut et al. | |
| 5,129,173 | A | * | 7/1992 | Kuykendall | 42/87 |
| 5,159,136 | A | | 10/1992 | Marsh | |
| 5,279,059 | A | * | 1/1994 | Howard | 42/50 |
| 5,309,660 | A | * | 5/1994 | Blackamore | 42/106 |
| 5,438,783 | A | * | 8/1995 | Sniezak et al. | 42/50 |
| 5,636,465 | A | * | 6/1997 | Johnson | 42/50 |
| 5,689,907 | A | * | 11/1997 | Cooley | 42/1.01 |
| 5,704,150 | A | * | 1/1998 | Milliman | 42/63 |
| 6,173,519 | B1 | * | 1/2001 | Garrett | 42/70.01 |
| 6,327,805 | B1 | * | 12/2001 | Clifton, Jr. | 42/49.01 |
| 6,389,978 | B1 | * | 5/2002 | Hooper et al. | 102/442 |

* cited by examiner

*Primary Examiner*—Michael J. Carone
*Assistant Examiner*—Troy Chambers
(74) *Attorney, Agent, or Firm*—James R. Muldoon; Hancock & Estabrook, LLP

(57) ABSTRACT

A gun barrel cleaning system adapted for storage in the pistol grip of a firearm. The gun barrel cleaning system generally comprises a carrier unit that is removably mounted within the cavity of the pistol grip by a flanged mounting bracket, and a plurality of gun barrel cleaning tools stored in the carrier unit. The carrier unit comprises a bottom plate and a plurality of upstanding walls which collectively define a cavity in which the tools are stored, and an open top end. A pair of diametrically opposed slotted openings are formed through opposing walls, and the mounting bracket flanges include wedges formed thereon which are adapted to engage respective ones of the slotted openings. The mounting bracket is attached to the pistol grip by a bolt, thereby interconnecting the carrier unit to the pistol grip.

9 Claims, 4 Drawing Sheets

16
22
24
26
28
32
34
36
36'
38
38'
39
40
12

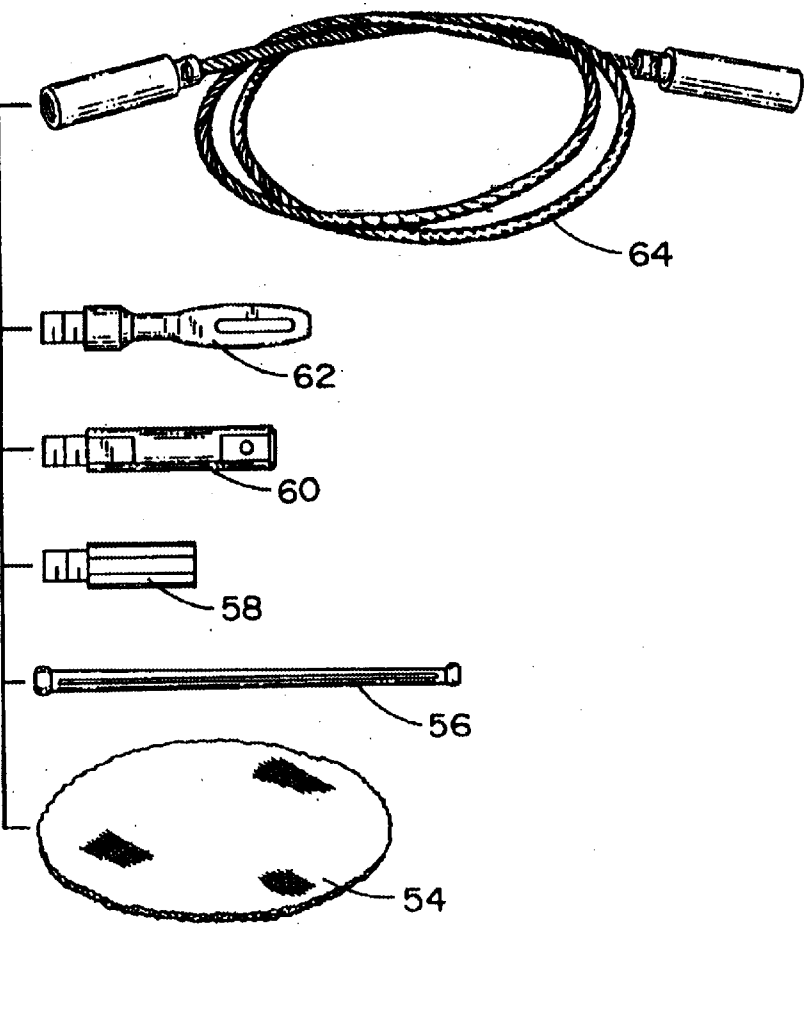
FIG. 12
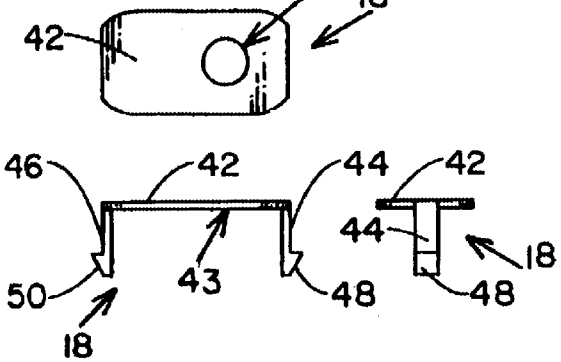
FIG. 10
FIG. 11
FIG. 9

GUN CLEANING KIT

BACKGROUND OF THE INVENTION

1. Field of Invention

The present invention generally relates to gun barrel cleaning kits, and more particularly to breech to muzzle cleaning kits that can be stored in a pistol gun.

2. Description of Prior Art

While firearms often are cleaned in the home, it is sometimes necessary or desirable for the gun barrel to be cleaned in the field or camp. The typical devices for cleaning gun barrels at home comprise an elongated rod with a brush attached to one end. Although these devices are mostly effective, they are not easily transportable due to their large size, and while some may be partiality disassembled to reduce their size, they remain bulky and cumbersome.

Gun barrel cleaning kits that can be stored on the person and easily transported are well known in the art. These devices generally include all the necessary cleaning tools, such as patches, bore brushes, flexible rods, obstruction removers, solvents, and various adapters and handles, stored in an easily carried case. Examples of such kits are exemplified in U.S. Pat. No. 4,716,673 to Williams, et al., the M-4/M-16 Soft Pack Kit NSN#1005-01-448-8513, and DMR-M14/M240G 7.62 NSN#1005-01-4633783 all of which are sold by Otis Technology, Inc., of Lyons Falls, N.Y. 13368.

Perhaps even more convenient than an easily carried case having the barrel cleaning implements stored therein, is a cleaning kit that can be stored directly in the gun. U.S. Pat. No. 856,016 to Balson discloses a gun stock having a chamber therein for receiving tools, serves as an example of this.

Certain firearms are provided with fore and aft pistol grips so that the user does not have to hold the barrel when firing the gun. An example of such a gun is the recently military issued M4A1 Close Quarter Battel Weapon. The grips of these guns may be manufactured to have a cavity formed therein. This cavity in the grip provides another alternative storage space for a cleaning kit.

3. Objects and Advantages

It is therefore a principal object and advantage of the present invention to provide a gun cleaning system that may be effectively stored in the pistol grip of a firearm.

It is another object and advantage of the present invention to provide a gun cleaning system that may be stored in the pistol grip of a firearm and will not interfere with the firearm's operation.

It is a further object and advantage of the present invention to provide a gun cleaning system that can be quickly and easily accessed from the pistol grip of a firearm.

It is an additional object and advantage of the present invention to provide a gun cleaning system that may be inexpensively manufactured.

Other objects and advantages of the present invention will in part by obvious, and in part appear hereinafter.

SUMMARY OF THE INVENTION

In accordance with the foregoing objects and advantages, the present invention provides a gun cleaning system that may be stored in the pistol grip of a gun. The gun cleaning system generally comprises a carrier unit removably mounted within the cavity of a pistol grip by a flanged mounting bracket, and a plurality of barrel cleaning toots housed within the carrier unit. The carrier unit and flanged mounting bracket are preferably molded from plastic, but may be manufactured by any suitable process and from any suitable material, such as metal or wood.

The carrier unit includes a solid bottom shaped to conform with the shape of the opening at the bottom of the pistol grip, and upstanding sidewalls defining a cavity therein and having an open top. The cross-sectional shape of the sidewalls is designed to correspond with and conform to the cross-sectional shape of the pistol grip. A pair of diametrically opposed, slotted openings are formed through the foreward and rearward sidewalls, adjacent the open top end of the carrier.

The flanged mounting bracket comprises a plate having a hole formed therethrough, and a pair of diametrically opposed flanges extending downwardly from the foreward and rearward edges of the plate. A bolt, such as an Allen Head bolt, passes through the opening formed through the bracket's plate, thereby interconnecting the bracket to the upper wall of the pistol grip. Once the bracket is attached to the grip, the carrier unit can be slid into the grip and mounted therein by the bracket's flanges engaging the slotted openings formed through the carrier's sidewalls.

The tools which include, for example, cotton patches, a flexible rod, a cleaning tip, an obstruction tool, a bore brush, adapters, handles, and solvent can be stored in the carrier prior to its insertion and interconnection to the pistol grip.

BRIEF DESCRIPTION OF THE DRAWINGS

The present invention will be more fully understood and appreciated by reading the following Detailed Description in conjunction with the accompanying drawings, in which:

FIG. 9 is a top plan view of the mounting bracket of the present invention;

FIG. 10 is a side elevation view thereof;

FIG. 11 is a front elevation view thereof; and

FIG. 12 is an exploded, side elevation view of gun cleaning tools in relation to the carrier unit of the present invention.

DETAILED DESCRIPTION

Figure 1:
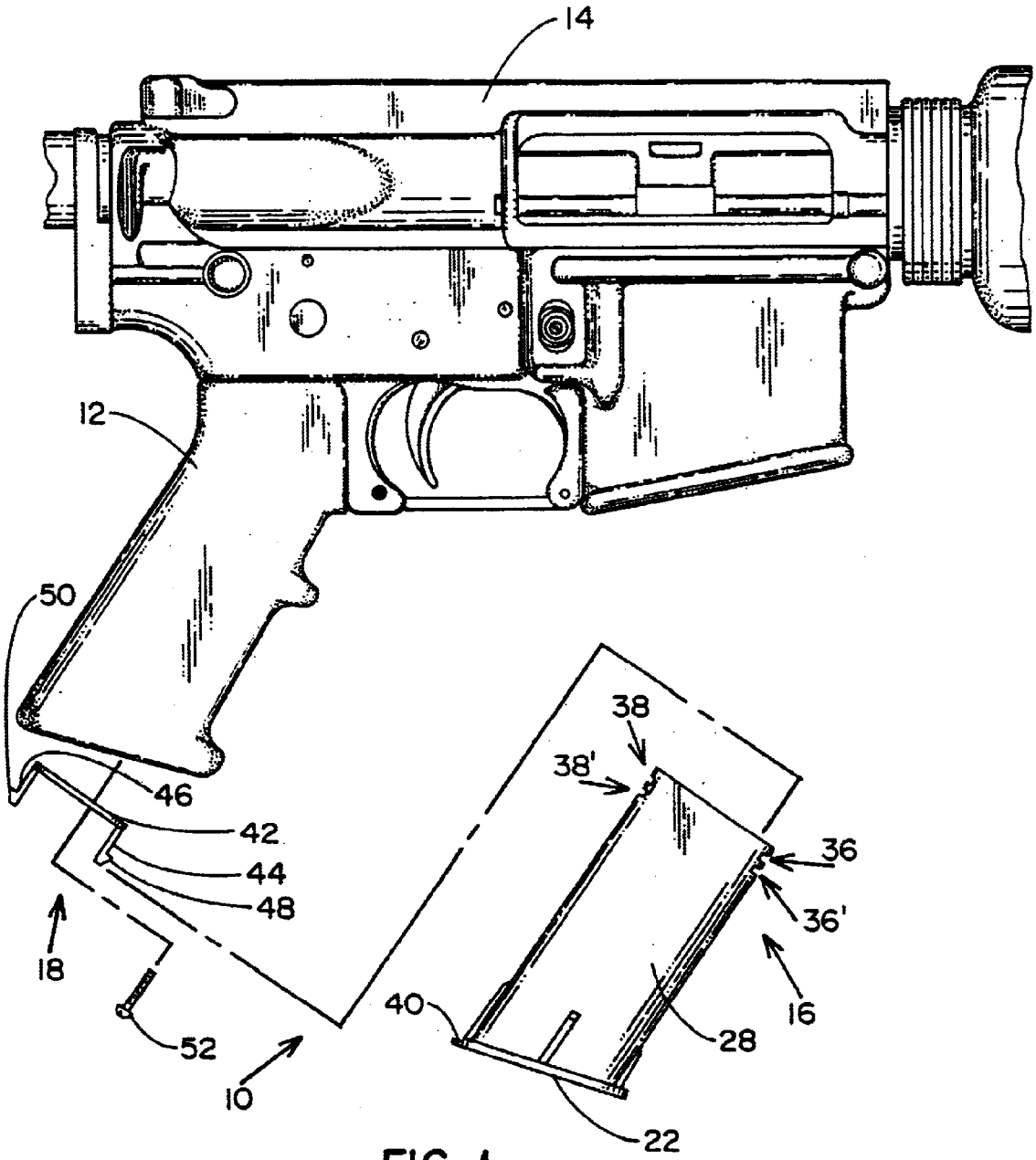
FIG. 1 is an exploded, partially fragmented, side elevation view of the present invention in relation to a pistol grip of a firearm.

Referring now to the drawings, wherein like reference numerals refer to like parts throughout, there is seen in FIG. 1 a gun cleaning system, designated generally by reference numeral 10, that may be stored within and interconnected to a pistol grip 12 of a firearm 14. Cleaning system 10 generally comprises a carrier unit, designated generally by reference numeral 16, a flanged mounting bracket, designated generally by reference numeral 18, for interconnecting carrier unit 16 to pistol grip 12, and a plurality of cleaning tools (see FIG. 12), designated generally by reference numeral 20, all of which may be stored within carrier unit 16.

With reference to FIGS. 3–8, carrier unit 16 generally comprises a solid bottom plate 22 that is shaped to correspond with and conform to the open bottom of pistol grip 12, and upstanding forward, rearward, and opposing sidewalls 24, 26, 28, and 30, respectively, which terminate at an open top and 32, and collectively define a cavity 34. A pair of diametrically opposed slotted openings 36, 38 are formed through forward and rearward walls 24,26 respectively, and a large cutout 39 is removed from sidewall 30. Bottom plate 22 includes a lip region 40 extending outwardly from rearward will 26 which may be engaged by a fingernail, screwdriver, knife, or the like and pried to disconnect carrier unit 16 from pistol grip 12. Optionally, a second pair of opposed slotted openings 36', 38', may be formed directly before openings 36, 38, respectively, to accommodate various sized cavities 34.

With reference to FIGS. 9–11, mounting bracket 18 generally comprises a plate 42 having an opening 44 formed therethrough, and a pair of diametrically opposed flanges 44, 46 extending downwardly from the plate's forward and rearward edges, respectively. Flanges 44, 46 each include a wedge 48, 50, respectively, formed therein that are designed to engage slotted openings 36, 38, respectively, and retain carrier unit 16 within pistol grip 12, as will be explained in further detail hereinafter.

Figure 2:
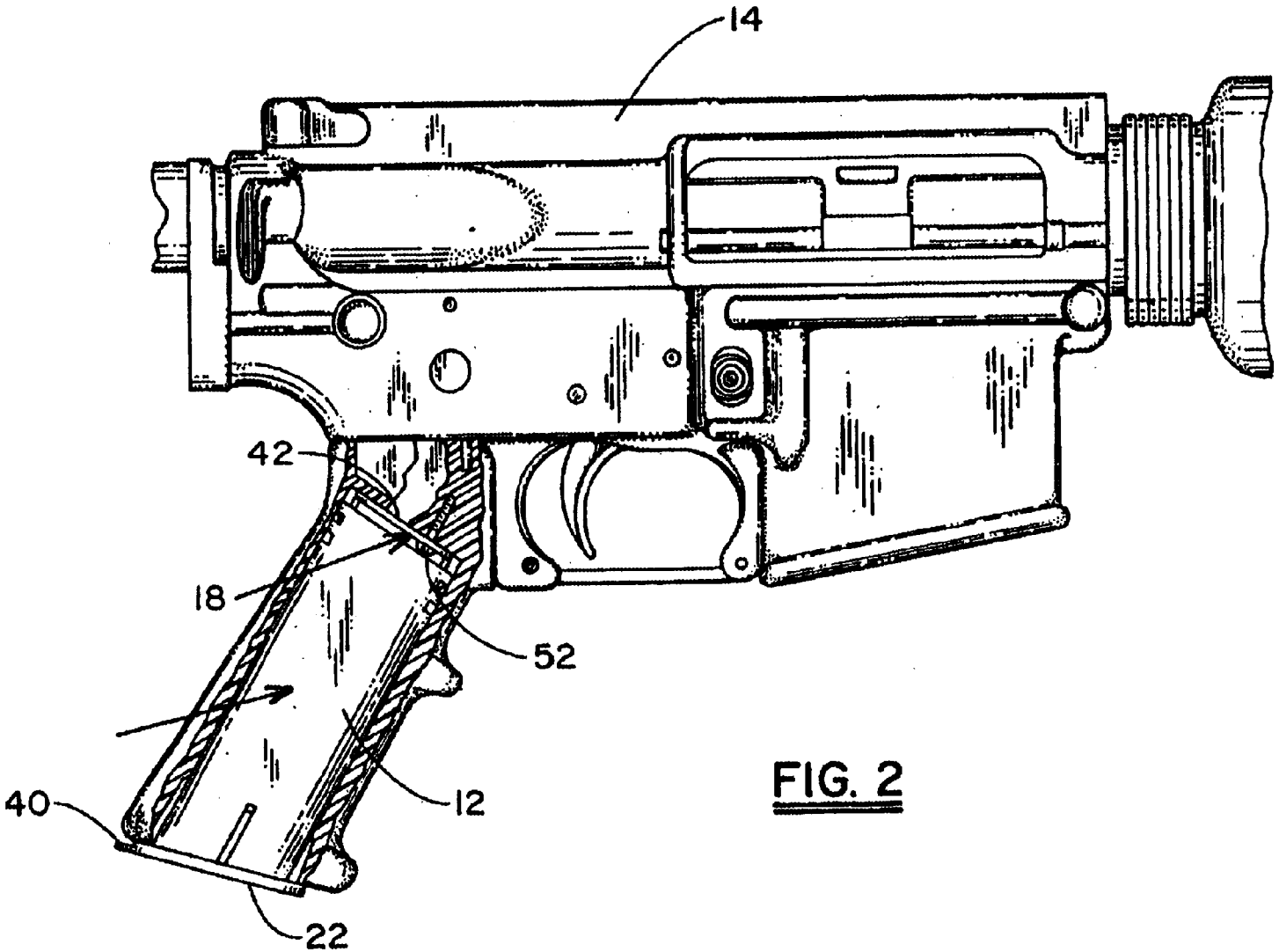
FIG. 2 is a side elevation view of a firearm with the pistol grip and present invention being shown in cross-section.
Figures 3, 4, 5, 6, 7, 8:
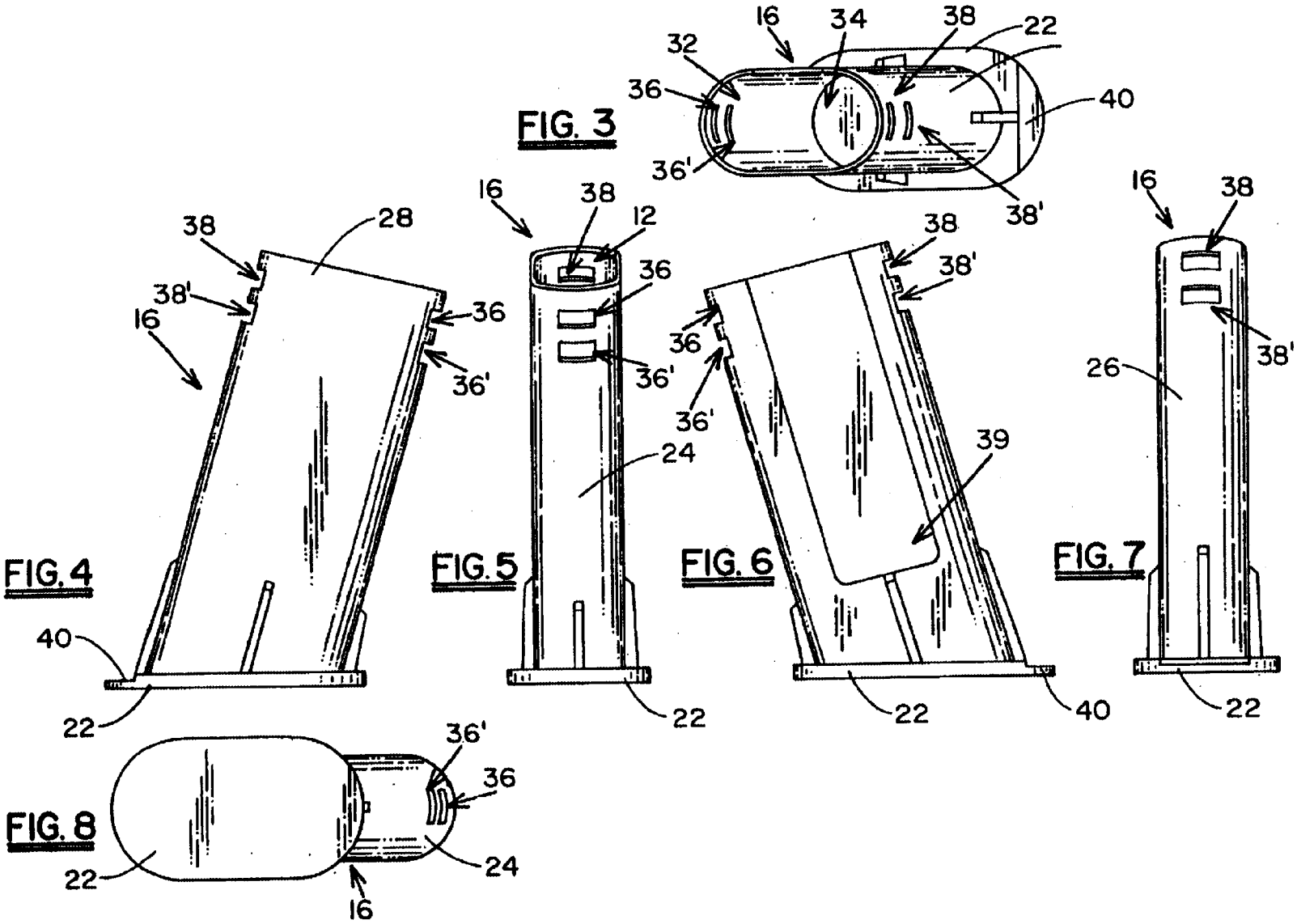
FIG. 3 is a top plan view of the carrier unit of the present invention.
FIG. 4 is a left side elevation view thereof.
FIG. 5 is a front elevation view thereof.
FIG. 6 is a right side elevation view thereof.
FIG. 7 is a rear elevation view thereof.
FIG. 8 is a bottom plan view thereof.

A bolt 52 is used to connect mounting bracket 18 to grip 12. With reference to FIGS. 1 and 2, bolt 52 passes through opening 44 formed through plate 42 and interconnects mounting bracket 18 to pistol grip 12. Carrier unit 16 may then be manually slid into pistol grip 12 until wedges 48, 50 engage slotted openings 36,38, or 36', 38', respectively, thereby interconnecting carrier unit 16 to mounting bracket 18, and hence, to pistol grip 12.

To disengage carrier unit 16 from pistol grip 12, a fingernail, knife, screwdriver, or other prying instrument can be used. The prying instrument should be placed on the upper surface of lip 40 and forced downwardly. A predetermined amount of force will cause wedges 48, 50 to disengage from slotted openings 36, 38 or 36', 38', respectively, thereby permitting carrier unit 16 to be easily removed from pistol grip 12.

A plurality of firearm cleaner tools 20 can be stored within carrier unit 16, as shown in FIG. 1. For example, cotton patches 54, handle 56, large obstruction remover 58, small obstruction remover 60, tip clearer 62, and flexible cable 64 may be stored within carrier unit 16 (other cleaning tools could obviously be stored as well). Tools 20 can be removed from carrier unit 16 through its open top 32 and/or accessed through cutout 39 removed from sidewall 30.

Although a preferred embodiment of the present invention has been illustrated in the accompanying drawings and described herein, it is understood that the scope and spirit of the present invention is not limited thereby, but rather extends to its full metes and bounds as defined in the accompanying claims.

What is claimed is:

1. A gun barrel cleaning system adapted for storage in a pistol grip, said cleaning system comprising:

a. a carrier unit; and b. a bracket for interconnecting said carrier unit to said pistol grip when positioned within said pistol grip, and comprising a mounting plate, and first and second flanges extending downwardly from said mounting plate.

2. The gun barrel cleaning system of claim 1, further comprising a plurality of gun barrel cleaning tools stored in said carrier unit.

3. The gun barrel cleaning system of claim 1, wherein said carrier unit comprises a bottom plate, a plurality of walls extending upwardly from said bottom plate and which collectively define a cavity therebetween, and an open top end.

4. The gun barrel cleaning system of claim 3, wherein said bottom plate includes a lip region extending therefrom.

5. The gun barrel cleaning system of claim 3, wherein one of said plurality of walls includes a notch cutout therefrom.

6. The gun barrel cleaning system of claim 3, wherein two of said plurality of walls each include a slotted opening formed therethrough and positioned adjacent said open top end.

7. The gun barrel cleaning system of claim 6, wherein said first and second flanges include first and second wedges formed thereon, respectively, wherein said first and second flanges are each adapted to engage a respective one of said slotted openings formed through said two walls.

8. The gun barrel cleaning system of claim 6, wherein said mounting plate includes an opening formed therethrough.

9. The gun barrel cleaning system of claim 8, wherein said bracket is connected to the pistol grip by a bolt passing through said opening formed through said mounting plate.

* * * * *